United States Patent [19]
Reick
[11] 4,224,173
[45] Sep. 23, 1980

[54] LUBRICANT OIL CONTAINING POLYTETRAFLUOROETHYLENE AND FLUOROCHEMICAL SURFACTANT

[75] Inventor: Franklin G. Reick, 228 West Pl., Westwood, N.J. 07675

[73] Assignee: Michael Ebert, Mamaroneck, N.Y.; a part interest

[21] Appl. No.: 914,908

[22] Filed: Jun. 12, 1978

Related U.S. Application Data

[60] Division of Ser. No. 809,805, Jun. 24, 1977, Pat. No. 4,127,491, which is a continuation-in-part of Ser. No. 708,222, Jul. 23, 1976, abandoned.

[51] Int. Cl.[2] ..... C10M 1/30; C10M 1/20; C10M 3/24; C10M 3/14

[52] U.S. Cl. ..... 252/52 A; 72/42; 252/58

[58] Field of Search ..... 252/52 A, 58; 72/42

[56] References Cited

U.S. PATENT DOCUMENTS

| | | | |
|---|---|---|---|
| 3,194,762 | 7/1965 | Browning et al. | 252/58 |
| 3,857,789 | 12/1974 | Krupin et al. | 252/52 A |
| 3,917,537 | 11/1975 | Eledon | 252/52 A |
| 3,933,656 | 1/1976 | Reick | 252/25 |
| 3,992,309 | 11/1976 | Dounchis | 252/52 A |
| 4,127,491 | 11/1978 | Reick | 252/16 |

*Primary Examiner*—Delbert E. Gantz
*Assistant Examiner*—Irving Vaughn
*Attorney, Agent, or Firm*—Michael Ebert

[57] ABSTRACT

A lubricating oil containing polytetrafluoroethylene particles and a fluorochemical surfactant which stabilizes the dispersion and creates a molecular surface tension skin on the surface of the oil to reduce volatilization losses during use in an internal combustion engine.

5 Claims, No Drawings

LUBRICANT OIL CONTAINING POLYTETRAFLUOROETHYLENE AND FLUOROCHEMICAL SURFACTANT

RELATED APPLICATIONS

This application is a division of application Ser. No. 809,805, filed June 24, 1977, entitled HYBRID LUBRICANT INCLUDING HALOCARBON OIL, (now U.S. Pat. No. 4,127,491) which in turn is a continuation-in-part of application Ser. No. 708,222, filed July 23, 1976, entitled HYBRID LUBRICANT, now abandoned.

BACKGROUND OF INVENTION

This invention relates generally to lubrication and lubricants, and more particularly to a hybrid lubricant in which solid lubricant particles are dispersed in a fluid lubricant carrier that may include a small but effective amount of halocarbon oil to react with the surface being lubricated.

Even the most carefully finished metal surfaces have minute projections and depressions therein which introduce resistance when one surface shifts relative to another. The application of a fluid lubricant to these surfaces reduces friction by interposing a film of oil therebetween, this being known as hydrodynamic lubrication. In a bearing, for example, the rotation of the journal causes oil to be drawn between it and the bearing so that the two metal surfaces are then separated by a very thin oil film. The degree of bearing friction depends on the viscosity of the oil, the speed of rotation and the load on the journal.

Should the journal start its rotation after a period of rest, it may not drag enough oil to float the surfaces apart; hence friction would then be considerably greater, the friction being independent of the viscosity of the lubricant and being related only to the load and to the "oiliness" property of the residual lubricant to stick tightly to the metal surfaces. This condition is referred to as "boundary lubrication," for then the moving parts are separated by a film of only molecular thickness. This may cause serious damage to overheated bearing surfaces.

The two most significant characteristics of a hydrodynamic lubricant are its viscosity and its viscosity index, the latter being the relationship between viscosity and temperature. The higher the index, the less viscosity will change with temperature. Fluid lubricants act not only to reduce friction, but also to remove heat developed within the machinery and as a protection against corrosion.

Though fluid film separation of rubbing surfaces is the most desirable objective of lubrication, it is often unobtainable in practice. Thus bearings built for full fluid lubrication during most of their operating phases actually experience solid-to-solid contact when starting and stopping. Solid surfaces in rubbing contact are characterized by coefficients of friction varying between 0.04 (Teflon on steel) and $>100$ (pure metals in vacuo). In contrast to fluid lubrication, solid lubrication is usually accompanied by wear of rubbing parts. Optical inspection of the surfaces after rubbing invariably reveals microscopic damage of the metal both when unlubricated and lubricated.

Typical solid lubricants are soft metals such as lead, the layer lattice crystals such as graphite and molybdenum disulphide, as well as the crystalline polymers such as Teflon (polytetrafluoroethylene). The integral bonding of these solid lubricants to the surfaces of the bodies to be lubricated is essential for good performance.

Under the severe operating conditions unusually encountered in automotive transmissions and in internal combustion engines, hydrodynamic or fluid lubrication is inadequate to minimize friction and wear; for fluid film separation of the rubbing surfaces is not possible throughout all phases of operation. Hence, the ideal lubricant for an engine or other mechanism having moving parts is one which combines hydrodynamic with solid lubrication. In this way, when adequate separation exists between the rubbing surfaces, a protective fluid film is interposed therebetween; and when the surfaces are in physical contact with each other, friction therebetween is minimized by layers of solid lubricant bonded to the surfaces.

In theory, one can best approach this ideal by lining the rubbing parts of engines with solid lubricant layers which are integrally bonded thereto, concurrent use being made of a lubricating oil which functions not only to provide hydrodynamic lubrication but also to cool the rubbing parts. In addition, the oil may carry synthetic organic chemicals to perform other functions to counteract wear and prevent corrosion.

The practical difficulty with attaining this ideal is that the parts coated with solid lubricants, such as a PTFE layer, are very expensive and therefore add considerably to the overall cost of the engine. Moreover, in TFE-coated parts which operate under rigorous conditions, the solid lubricant layers bonded thereto have a relatively short working life, so that it is not long before the only lubricant which remains effective in the engine is the fluid lubricant.

In order to provide a lubricating action which is both solid and fluid, my prior U.S. Pat. No. 3,933,656 discloses a modified oil lubricant which is suitable for an internal combustion engine provided with an oil filter as well as for many other applications which call for effective lubrication throughout all phases of operation. This modified lubricant is constituted by major amounts of a conventional lubricating oil intermingled with minor amounts of an aqueous dispersion of polytetrafluoroethylene particles in the sub-micronic range in combination with a neutralizing agent which stabilizes the dispersion to prevent agglomeration and coagulation of the particles. Thus the modified lubricant is capable of passing through the oil filter without separating the solid particles from the oil in which it is dispersed.

As pointed out in my prior patent, when use is made of this modified lubricant in an internal combustion engine, the engine "runs progressively smoother as the internal surfaces acquire a coating of Teflon." Thus the Teflon solid lubricant coating is applied to the rubbing parts by the circulating fluid lubricant. This modified lubricant has many significant advantages; for, as indicated in my prior patent, it reduces wear and thereby prolongs engine life, it makes possible a sharp reduction in the emission of pollutants and also effects a significant improvement in fuel economy, the last factor being of overriding importance in a fuel-short world.

In the modified lubricant disclosed in my prior patent, a stabilized aqueous dispersion of solid lubricant particles (PTFE) is intermingled with the oil lubricant in the engine itself. Because of the water involved, the aqueous dispersion tends, when introduced into the oil, to break up into rather large globules, rather than to become evenly dispersed or homogenized in the oil. Hence, my modified lubricant, though effective in reducing friction, is not as effective as it would be with a more uniform dispersion.

Moreover, the Teflon coatings which form on the surface of the internal rubbing metal parts do not always remain securely bonded thereto in all areas, and while the solid lubricant coatings on some areas are often renewed in the course of engine operation, this factor also militates against the full and effective utilization of the modified lubricants disclosed in my prior patent.

SUMMARY OF THE INVENTION

In view of the foregoing, the main object of this invention is to provide a hybrid lubricant in which a stabilized colloidal dispersion of solid lubricant particles (PTFE) is uniformly dispersed in a fluid lubricant carrier to form a hybrid lubricant which when diluted with a major amount of a conventional fluid lubricant (oil or grease) functions in the environment of rubbing surfaces to develop a layer of solid lubricant on these surfaces.

A salient feature of the present invention is that rubbing surfaces to which the hybrid lubricant is applied have the continuing benefit of both solid and fluid lubrication, thereby minimizing friction under all operating conditions, regardless of their severity.

More specifically, it is an object of this invention to provide a hybrid lubricant of the above-type which includes a small but effective amount of a halocarbon oil and which acts to impregnate the microscopic voids and rough spots on a typical rubbing surface (even one that is highly polished), with polytetrafluoroethylene particles of sub-micronic size to create an integrally-bonded solid lubricant layer thereon that is super-smooth and extraordinarily slippery.

Briefly stated, these objects are attained in a hybrid lubricant in which an aqueous dispersion of colloidal particles (PTFE) is treated with a charge-stabilizing agent and then intermingled with a fluid lubricant carrier to form an emulsion.

In order to reduce the size of the globules in the emulsion, a dispersant polymer is added thereto, thereby providing a homogenized emulsion to which is added an adsorbent surfactant having an affinity for the rubbing surfaces to which the lubricant is to be applied, thereby rendering these surfaces conducive to impregnation by the PTFE particles and the fusion of the particles thereto to create a solid lubricant layer.

Also included in the hybrid lubricant is a small but effective amount of halocarbon oil which acts to fluorinate the metal surfaces being lubricated to render these surfaces more receptive to impregnation by PTFE particles. The hybrid lubricant may further include a neutral synthetic barium sulfonate serving to improve the long-term stability of the PTFE dispersion and to thereby inhibit settling thereof.

The use of a hybrid lubricant as an additive for standard crankcase oil in a diesel or internal combustion engine brings about distinctly better performance, increased mileage for a given amount of fuel, faster cold starts and an absence of hesitation. The additive reduces friction and wear, yet it never coagulates and does not clog oil filters. And because the hybrid lubricant makes it possible to operate at lower idling speeds and with very learn air/fuel mixtures, the emission of unburned hydrocarbons and carbon monoxide from the exhaust is sharply reduced, thereby minimizing the discharge into the atmosphere of pollutants.

DESCRIPTION OF INVENTION

A hybrid lubricant in accordance with the invention includes a solid lubricant in the form of microfine particles of polytetrafluoroethylene (PTFE). Since these particles must pass easily through an oil filter and between closely machined metal surfaces such as those existing in hydraulic valve lifters, it is essential that the particles be of sub-micronic size. Suitable, therefore, as the starting material for a hybrid lubricant in accordance with the invention are the DuPont "Teflon" dispersions TFE-42 and T-30 whose particle sizes are in the 0.05 to 0.5 micron range. Also acceptable is the "Fluon" ADO 58 TFE colloidal dispersion manufactured by ICI (Imperial Chemical Industries, Ltd.).

Techniques for producing tetrafluoroethylene polymers and dispersions thereof are disclosed in the Plunket U.S. Pat. No. 2,230,654, and the Renfrew U.S. Pat. No. 2,534,058 and the Berry U.S. Pat. No. 2,478,229. These TFE colloidal aqueous dispersions are all highly unstable. As noted in a publication of DuPont, the manufacturer of "Teflon" brand dispersions:

"Teflon 42 dispersion will settle on prolonged standing or a heating above 150° F. It can be redispersed by mild agitation. Stock being stored for an indefinite period should be redispersed at least every 2 weeks by inverting or rolling the container. High speed stirring or violent agitation should be avoided since this will cause irreversible coagulation. The dispersion should be protected from the atmosphere to prevent coagulation by drying. It should be protected against freezing at all times to prevent irreversible coagulation."

"The T-30 and similar aqueous dispersions are hydrophobic colloids with negatively charged particles. In a dispersion in which 60% is in the form of solids, there are approximately 0.9 grams of Teflon for each cc of solution."

It is important that the reason for this inherent instability be understood. Though the colloidal particles generally carry a negative charge in an aqueous dispersion, the charges are not uniformly distributed. The negative charge varies over the particle surfaces and the particles, therefore, effectively behave as microscopic electrets having quasi-positive as well as negative charges. As a consequence, the bi-polar particles attract each other and agglomeration occurs. Hi-shear, heat, Brownian movement, adsorbed gases and the particle density all cause problems with unstable TFE dispersions.

It has been observed under a dark field microscope that the particles in an unstable PTFE dispersion can grow into clusters or spheroidal clumps that behave as gross particles. This growth or agglomeration continues until the surface charge becomes uniform. In some instances, the particles join together in linear chains to form long-fiber-like clusters.

Under the microscope, the unstable dispersion in its virgin stage (i.e., fresh out of the reactor) appears as a galaxy of dispersed particles; but with agitation or stirring, the particles then proceed to agglomerate. Under high shear and impact, the agglomerates consolidate into a tough, gummy mass which is unsuitable in an oil additive, for it is easily filtered out in the circulating oil system.

In one preferred hybrid lubricant in accordance with the invention, the following steps are involved:

STEP NO. 1

The aqueous dispersion of colloidal PTFE particles must first be rendered stable to avoid agglomeration of the particles. For this purpose, use is preferably made of a fluoro surfactant which acts to neutralize or stabilize the surface charges in the particles to make them more uniform and thereby prevent "electret" effects causing agglomeration.

Best results are obtained when the PTFE dispersion to be treated is received from the pressure reactor immediately following polymerization. PTFE particles are extremely hydrophobic and air tends to wet the particles better than water. It is for this reason that the solutions are usually shipped with a mineral oil layer to keep gases away and retard agglomeration. And while to make the hybrid lubricant, one may use commercially-available PTFE dispersions which have been shipped and stored as long as the dispersions are reasonably free of agglomerates, it is better to start with ex-reactor dispersions to sidestep the danger of agglomeration.

Fluoro surfactants are available which are anionic, cationic or nonionic. Among these fluoro surfactants are Zonyl (DuPont), Fluorad (3M) and Monoflor (ICI). Zonyl is a modified polyethylene glycol type that is nonionic. For engine lubrication applications, good results have been obtained with an anionic (−) fluoro surfactant commercially available from ICI as MF 32. MF 32, or Monflor 32 produced by ICI, is of particular interest, this being an anionic fluorochemical whose composition is 30% w/w/ active solids in diethylene glycol mono butyl ether.

It has been found that to charge-neutralize and stabilize the PTFE dispersion, use may also be made of positive-charged colloids of alumina (ALON—G.L. Cabot). Also, ammonium sulfide has been found effective in forming a stable dispersion. These positively-charged particles are adsorbed on the negative PTFE colloid. Because alumina is in colloidal powder form, it introduces no significant abrasive qualities to the lubricant. This charge-neutralizing agent is believed useful in certain special high temperature applications.

STEP NO. 2

The stabilized aqueous PTFE dispersion produced in Step No. 1 is then intermingled with a fluid lubricant carrier, preferably one which is the same or fully compatible with the lubricating oil in the engine to which the hybrid lubricant is to be added. By intermingling the stabilized aqueous PTFE dispersion with the carrier, an emulsion is formed.

For this purpose, use may be made of Quaker State 10W-40 SAE lubricating oil, Shell X-100, or Uniflo oil. Thus, if Quaker State oil is normally used in the crankcase of the engine, the same oil may be used as the carrier for the dispersion.

STEP NO. 3

In the emulsion formed in step no. 2, the aqueous dispersion is distributed throughout the oil carrier in the form of relatively large globules. It is desirable that this emulsion be homogenized; that is, subjected to turbulent treatment to cause the globules to break up and reduce in size to create a fine uniform dispersion of colloidal TFE in the fluid lubricant carrier.

To promote such homogenization, use is made of a polymeric dispersant such as ACRYLOID 956 manufactured by Rohm and Haas. This dispersant, which is generally used as a viscosity index improver or sludge dispersant, is a polyalkylmethacrylate copolymer in a solvent-refined neutral carrier oil. Also useful for this purpose are GANEX V516 polymeric dispersants manufactured and sold by GAF.

Where the hybrid lubricant is to be used as an additive for grease (wheel bearings, chassis lubes, etc.) rather than in lubricating motor oil, then the carrier oil is treated with gelling agents such as grease-forming stearates of Zn, Ba, Al and Ca. Those are metal salts of higher monocarboxylic organic acids. Suitable stearates for this purpose are those manufactured by the Organics Division of Whitco Chemical Corporation of New York.

To obtain a very fine particle dispersion in the emulsion, this step is preferably carried out in two successive stages. In the first stage, a portion of the dispersant is sheared into the high viscosity Acryloid 956, after which the remainder is added.

STEP NO. 4

We now, as a result of carrying out steps 1 to 3, have homogenized emulsion in which stabilized TFE particles are uniformly dispersed in a fluid lubricant carrier. In the final step, added to this emulsion is an adsorbant surfactant which will render the rubbing surfaces to be lubricated conducive to impregnation by the colloidal particles of solid lubricant, the impregnated particles fusing to those surfaces to create super-smooth and highly slippery layers thereon.

Where the surfaces to be lubricated are metal, the surfactant is one appropriate to metal. A preferred surfactant for this purpose is Surfy-nol 104 manufactured by Airco Chemicals and Plastics. This is a white,, waxy, solid tertiary, acetylenic glycol which has an affinity for metal and functions as a wetting agent. It improves adhesion on metal due to its excellent wetting power.

Because of the effect of this non-ionic, adsorbent surfactant on metal surfaces, the colloidal PTFE particles in the hybrid lubricant which are brought in contact with these surfaces in the course of operation are impregnated into the granular interstices or voids in the metal and are fused thereto.

For rubbing surfaces constituted by steel against anodized aluminum, the acid phosphate esters work well—such as GAFAC (free acids of complex phosphate esters made by GAF). These can be neutralized with amino silanes or propargyl alcohol to form lubricants with extraordinary low surface friction.

Suitable for high-speed, light duty application is Pegosphere, a polyethylene glycol, or 200 ML, a monolaurate, both made by Glycol Chem, Inc. IGEPAL CO520, made by GAF (General Analine & Film Corp.), is a non-ionic surfactant (dodecylphenoxy polyethylenoxy) which has the advantage of being easily removed by water. This is useful when the surface to be lubricated, such as a can formed in a can-forming machine, must later be cleaned.

Thus the choice of this surfactant is dictated by the nature of the surface to be lubricated. The selected surfactant must have an affinity for this surface and act to wet this surface to attract the PTFE particles.

The following is one preferred formulation in accordance with the invention:

A. The starting material is 20 gm of an "ex-reaction" aqueous dispersion of colloidal PTFE (17% solids).
B. A fluorocarbon surfactant (Zonyl) is added (20 drops) to the TFE dispersion and the dispersion is gently mixed for adsorption to take place to produce a stabilized PTFE dispersion.

C. The stabilized dispersion is then high-sheared with 100 grams of an oil carrier, such as Quaker State 10W-40 SAE to form an emulsion.

D. The emulsion is then high-sheared with a dispersant polymer (100 grams of Acryloid 956) to homogenize the emulsion.

E. This homogenization is continued with an additional 100 grams of Acryloid 956.

F. The homogenized emulsion then is low sheared with 30 grams of Surfy-nol 440, an adsorbent surfactant for metal surfaces. Surfy-nol is the trademark of Airco Chemicals and Places for a group of organic surface-active agents (acetylenic alcohols or glycols or their ethoxylated derivatives: waxy or powdered solids, or liquids, non-foaming, non-ionic).

APPLICATONS

A hybrid lubricant in accordance with the invention may be added to the crankcase oil in the internal combustion engine of an automobile, the hybrid lubricant being diluted by whatever oil is contained in the crankcase. Dilution tests have indicated that relatively small quantities of the hybrid lubricant have a profound effect on the lubricity characteristics of standard lubricating oils. Effective results have been obtained with a dilution ratio of a hybrid lubricant of the type given in the Typical Formulation to Quaker State 10W-40 SAE lubricating oil in a range of about 1:10 to about 1:40.

When the hybrid lubricant is added to the crankcase oil, a significant improvement is experienced in the operating characteristics of the vehicle. This improvement becomes even more dramatic with time as a strongly adherent PTFE layer or skin proceeds to form on the rubbing surfaces of the internal working parts of the engine. This skin is self-healing and even if bruised it will be regenerated in the course of operation.

With the concurrent use of both solid and fluid lubricants, friction is drastically reduced and it becomes possible to fine-lean the air-fuel mixture in the engine carburetor to an extent not previously feasible and to lower the engine speed in idle to a rate much below its normal operating rate, with a consequent marked reduction in the emission of pollutants and improved fuel economy. And because wear is minimized, the engine life is extended.

The hybrid lubricant is also useful in metal working and metal forming operations of various sorts as well as in all situations involving rubbing surfaces wherein it is advantageous to combine solid and fluid lubricating action.

In comparative abrasion tests (steel against aluminum) run with a conventional engine oil as a control (QS 10W-40), use of the control oil in the interface of a rotating steel abrader run against an anodized aluminum flat piece, resulted in a rapid temperature rise to over 100° C., with galling and failure taking place in about 15 minutes; whereas with the hybrid lubricant under the same test conditions, the gall resistance is maintained for more than four hours, with the temperature rise in this period not running much higher than 60° C. A photograph of the aluminum test piece before the test was run with a hybrid lubricant, taken with an electron microscope, reveals a seemingly rough, granular surface, whereas after the abrasion test, the same surface (magnification 10,000×) is smooth, the surface having been radically transformed by a PTFE layer filling the surface crevices.

In practice, one may for certain extra heavy-duty applications, such as in diesel engines or in military vehicles, provide for this purpose a blend of a hybrid lubricant in accordance with the invention with a solid lubricant such as graphite.

Another important aspect of a hybrid lubricant in accordance with the invention is that when added to the standard lubricating oil of an internal combustion engine, it gives rise to uniform and repeatable oil consumption characteristics not heretofore attainable. As noted in the article published by the Society of Automotive Engineers, "Effects of Oil Composition on Oil Consumption"—Orrin et al. (Automotive Engineering Congress, Detroit, Mich.—Jan. 11 to 15, 1971), "Most investigators agree that one of the main problems in oil consumption study is that engines do not consume oil at the same rate after being shut down and restarted."

While this article states that "the reasons for this phenomenon are unknown despite 40 years of research," the same article calls attention to a fact which obviously accounts, at least in part, for this lack of repeatability. Thus the article notes that "with low viscosity oils at certain engine conditions, boundary lubrication is approached."

As pointed out previously, when boundary lubrication conditions occur, the rubbing surfaces are effectively in contact and in the environment of an engine, the parts may gall and stick, making restarting difficult, which is why typical engine oil consumption characteristics are uneven. Indeed, as indicated in the text "Analysis and Lubrication of Bearings" by Shaw (McGraw Hill, 1949), it is extremely desirable that metallic contact be avoided, for this inevitably leads to torn and abraded bearing surfaces. But with the present invention, in which the parts in the engine become protectively coated with a solid lubricant, this drawback is obviated, and the engine operates smoothly at all times.

In the text, "Design of Film Bearings" by Trumpler (McMillan—1966), the section (page 210) on "Boundary Lubrication" points out that during a contact time of perhaps a few ten-thousandths of a second, local temperatures of the order of 1800° F. were reached at the contact point of the sliding surfaces of a bearing, although the bulk of the metal remained relatively cool.

When using a hybrid lubricant with a graphite solid lubricant as an additive therein in accordance with this invention, such high temperatures and pressure conditions may cause an interaction between the graphite and the PTFE material to produce a graphite fluoride layer on the sliding surfaces. As reported in the article published by the Society of Automotive Engineers, "A Review of Solid Lubrication Technology"—M. E. Campbell (National Farm Machinery Meeting—Milwaukee, Wis., Apr. 13 to 16, 1971), graphite fluoride exhibits friction coefficients equal to or superior to molybdenum disulfide and graphite.

It has long been recognized that the lower the viscosity of a lubricating oil in an automobile engine, the better the fuel economy. With an engine of given power, the greater the viscosity of the oil, the larger the portion of power that is dissipated to overcome oil drag or fluid friction. Thus, Zamboni, "Additive Engine Oils," published by the Petroleum Education Institute—Los Angeles, 1945—indicates that with a given automobile using SAE 10 (low viscosity), the fuel consumption is 17.75 miles per gallon, whereas with the same automobile using SAE 60 (high viscosity), the fuel consumption is 14.10 miles per gallon.

On the other hand, when using conventional low viscosity oils, boundary layer lubrication conditions are often encountered, with destructive effects on the engine. It is for this reason that lubricating oils presently on the market are targeted for SAE 30 to 40 at normal operating temperatures, with a consequent loss in fuel economy.

But with a hybrid lubricant in accordance with the invention, it becomes possible to take full advantage of a very low viscosity oil without fear of adverse boundary lubrication effects, for the solid PTFE lubricant layer formed on the sliding surfaces overcomes these effects. Preferably, the very low viscosity oil used in conjunction with the hybrid lubricant should be a synthetic oil of the esterlube type.

It is known that fluorocarbon surfactants, when on the surface of a gasoline supply at the interface of the gasoline and air, give rise to a surface tension skin which minimizes volatilization of the gasoline and cuts down evaporation losses. In the hybrid lubricant formulation in accordance with the invention, which makes use of a fluorocarbon surfactant as the charge-neutralizing agent for the PTFE dispersion, excesses of this same surfactant will form a molecular surface tension skin on the surface of the lubricating oil to which the hybrid lubricant is added, thereby reducing volatilization losses.

HYBRID LUBRICANT INCLUDING HALOCARBON OIL:

In the improved formulation to be described hereinafter, in addition to a stabilized PTFE dispersion and other essential ingredients of the hybrid lubricant, the composition further includes a small but effective amount of halocarbon oil, preferably oil 10–24 produced by Halocarbon Products Corporation of Hackensack, New Jersey.

Halocarbon oils are saturated, hydrogen-free chlorofluorocarbons which are chemically inert, have high thermal stability and good lubricity as well as high density and non-polar characteristics. They are made by controlled polymerization techniques and then stabilized so that the terminal groups are completely halogenated and inert.

While halocarbon oils are excellent lubricants and can be substituted directly for conventional lubricants in some applications, their use in automotive engines and other machines having similar metals has heretofore been interdicted.

The reason for this is that the typical internal combustion engine has aluminum pistons, and in some cases the engine block is of cast aluminum. The use of halocarbon lubricants in contact with aluminum may initiate a destructive reaction. Indeed, as pointed out in the booklet entitled "Halocarbon Chlorofluorocarbon Lubricants" published (1970) by Halocarbon Products Corporation, "The extremely high localized temperatures of minute seizure of aluminum have been known to cause a chemical reaction between chlorofluorocarbon oils and aluminum with a resulting detonation."

However, in the context of the present invention, a halocarbon oil in the hybrid lubricant containing dispersed PTFE particles serves to produce an advantageous reaction; for this reaction, when the relative amount of halocarbon oil present is quite small, acts to fluorinate the metal surfaces being lubricated. In the case of aluminum surfaces, this results in a complex aluminum fluoride layer that renders the metal surface highly receptive to the PTFE particles which then create a solid lubricant surface that is highly adherent to the metal and acts to minimize friction.

Also, when the hybrid lubricant in accordance with the invention includes graphite particles as well as halocarbon oil, this gives rise to the formation of a graphite fluoride layer on the metal surfaces of extremely low friction.

A preferred procedure for producing a hybrid lubricant which includes a small but effective amount of halocarbon oil is as follows:

Step A: The following substances are thoroughly intermixed: 1200 gm Halocarbon Oil (oil 10–25 of Halocarbon Products Corporation—This oil has limited solubility in mineral oils) and 1500 gm Monoflor 52 (non-ionic fluorochemical surface-active agent produced by ICI—this surfactant is oil soluble).

Step B: The mixture produced by Step A is thoroughly intermingled with 1 gallon Quaker State lubricating oil (10W-40 SAE) to produce a non-aqueous emulsion, hereinafter referred to as Component I.

Step C: To produce a dilute, stabilized PTFE aqueous dispersion, use is made of 2400 CC of a PTFE dispersion (ADO/38 of ICI, and T-42 of DuPont) and 2.5% Monoflor 32. The Monoflor 32 of ICI acts as a charge-neutralizing agent, and the resultant stabilized dispersion is then diluted with distilled water to reduce its solid content to 17%.

Step D: The stabilized PTFE dispersion produced in step C is then thoroughly intermingled with 2 gallons Quaker State lubricating oil (10W-40 SAE). The resultant emulsion of the stabilized aqueous PTFE dispersion in oil produces Component II.

When mixing the PTFE dispersion in oil, it is important that the mixing action be thorough and yet not excessively violent, for this would disturb the stability of the dispersion. For this purpose, use is preferably made of a rotating wire brush operating at high speed (i.e., 3600 RPM) within a mixing vessel. The brush is provided with an annular array of upstanding bristles, oil being fed into the core of the brush and being centrifugally hurled toward the periphery through the thicket of bristles which serves to work the dispersion into the oil without undue impact or shear forces. Collectively, the wire bristles forming the brush bring about a very thorough intermingling of the constituents.

Step E: Components I and II are then blended together and thoroughly intermingled (low shear) with: 4 gallons of ACRYLOID 956 (warm). This polymeric dispersant serves to uniformly homogenize the emulsion and to prevent the formation of large globules.

Step F: Added to the homogenized emulsion produced by Step E is 1000 cc Surfy-nol (mixture of 104/440 in 2 to 1 ratio). Surfy-nol 104 is solid at room temperature, whereas Surfy-nol 440 is then liquid.

These surfactants have an affinity for metal and serve as a wetting agent; facilitating adhesion of the PTFE particles to the rubbing metal parts.

Step G: When the Surfy-nol has been uniformly mixed into the homogenized emulsion, one then adds thereto 3 lbs. of Neutral Barium Petronate (50-S).

This constituent, which is produced by Witco Chemical Corporation, is a synthetic barium sulfonate with a low viscosity, providing ease of handling coupled with a high barium sulfonate concentration. Barium petronate 50-S is oil soluble and possesses the ability to increase the spreading coefficient. In the context of the present invention, it improves the long term stability of the PTFE dispersion and inhibits settling thereof.

Step H. Finally, the above is dispersed in: 3 gallons Quaker State Oil (10W-40 SAE). This produces a hybrid lubricant in accordance with the invention which may be added to a standard lubricant to improve its lubricity and to cause the formation of a PTFE coating on the rubbing surfaces being lubricated.

FURTHER APPLICATIONS

The hybrid lubricant in accordance with the invention may also be used to impregnate porous bearings of graphite, carbon, bronze or aluminum to improve their bearing characteristics by the addition to the bearing surfaces of low-friction PTFE particles. When such bearings are impregnated with an aqueous PTFE system, the vapor pressure of the water causes trouble and vigorous boiling limits the available pressure differential.

But with the PTFE particles in an oil emulsion as disclosed above, one may place the bearing to be impregnated in a vacuum chamber and then after a high vacuum is drawn, open the chamber valve to admit the hybrid lubricant to immerse the bearing.

After the hybrid lubricant saturates the bearing, the chamber is vented to the atmosphere, this action causing the PTFE particles to be driven into the bearing pores. Finally, one volatilizes the oil from the bearing, the PTFE particles remaining within the bearing pores. A bearing so treated operates at low temperatures because of reduced friction and has a prolonged life.

An important practical application for a hybrid lubricant in accordance with the invention is as an additive for a low-viscosity lubricant, particularly for commercially-available, low-viscosity synthetic lubricants such as Mobil 1. This commercial lubricant provides improved gas mileage in a vehicle whose engine is in good working order, for it reduces the amount of energy wasted in overcoming oil drag or fluid friction.

But with many engines which are in somewhat worn condition, there are numerous capillary leakage paths through which a low viscosity oil such as Mobil 1 finds its way, as a consequence of which, the oil loss as a result of leakage is quite serious.

However, when a hybrid lubricant in accordance with the invention is added to the low viscosity oil, the PTFE particles penetrate the capillaries and act to plug the leakage paths so that in addition to improving the lubricity characteristics of the low viscosity oil, the additive obviates the leakage problem.

The hybrid lubricant is of particular value in connection with commercial chain saws; for such gasoline motor-driven saws make use of pumps which meter oil to the endless chain. Because chain saws are subjected to sudden very heavy loads, the chain tends to run very hot and any failure of the oil supply thereto may be fatal. Moreover, even when a chain saw is operated correctly with ordinary lubricants, the temperature of the chain will often rise in the course of a sawing operation to a level at which it becomes necessary to discontinue sawing to prevent chain failure. But when a hybrid lubricant is added to the standard lubricating oil for the chain, the resultant PTFE coating on the rubbing metal surfaces markedly reduces the heat dissipation and results in a better operating saw whose mechanism will not be damaged by overheating. Also, the reduction affords increased power and superior cutting ability.

Another significant aspect of the invention is that it makes it feasible to use a smaller engine operating at very high speed to do the work of a larger engine operating at a lower speed. Engines usually function at their optimum efficiency at higher than their specified normal speeds, but because of the heating encountered with ordinary lubricants, optimum high speed operation cannot be tolerated. However, by adding the hybrid lubricant to the conventional lubricating engine oil, higher normal speeds and more efficient operation is made feasible.

The invention also makes feasible the production of air-cooled engines, thereby dispensing with the troublesome water cooling systems found in typical internal combustion engines. As pointed out previously, the hybrid lubricant acts to reduce friction to a degree causing the engine to run much cooler than with conventional lubricants, and at the same time it lays down a layer of solid lubricant on the rubbing surfaces. This has made it possible in a series of tests to run a standard automotive vehicle having a conventional water-cooling system without any water in the radiator; and while the engine temperature then rose to a high level, it did not reach a point causing engine seizure and failure which would have otherwise inevitably occurred.

It is known that making a small engine to the work of a larger one saves fuel. Also, noxious emissions are reduced. Thus the Garrett Corporation maintains, in a recent advertisement, that by the use of their turbochargers which are adapted to make a 230 cubic inch engine do the work of a 350 cubic inch engine, they can increase the miles per gallon of the engine by nearly 20%. Garrett Corporation claims that "if the entire U.S. auto fleet used turbocharged smaller engines, we could save 350,000,000 barrels of oil per year." A more considerable saving could be effected by the use of the hybrid lubricant in these engines.

While there have been shown and described preferred embodiments of a hybrid lubricant including halocarbon oil in accordance with the invention, it will be appreciated that many changes and modifications may be made therein without, however, departing from the essential spirit thereof.

I claim:

1. A lubricant for use in the crankcase of an internal combustion engine and in similar applications, said lubricant comprising:

(A) lubricating oil providing a working lubricant applicable to the metal rubbing surfaces of the engine, said oil having particles of polytetrafluoroethylene dispersed therein to enhance its lubricating characteristics; and (B) a fluorochemical-surfactant to stabilize the dispersion to prevent agglomeration of the particles, the amount of said surfactant being an excess of that necessary to stabilize the dispersion to a degree creating a molecular surface tension skin on the surface of the lubricating oil to reduce volatilization losses of the oil when the lubricant is heated to a high temperature in the course of engine operation.

2. A modified lubricant as set forth in claim 1, wherein said fluoro-surfactant is anionic.

3. A modified lubricant as set forth in claim 2, wherein said anionic fluoro-surfactant contains active solids in diethylene glycol mono butyl ether.

4. A modified lubricant as set forth in claim 1, wherein said fluoro-surfactant is nonionic.

5. A modified lubricant as set forth in claim 4, wherein said nonionic fluoro-surfactant is of the polyethylene glycol type.

* * * * *